United States Patent [19]

Golick

[11] 4,036,503

[45] July 19, 1977

[54] PUZZLE GAME

[76] Inventor: Martin Lance Golick, 217-02 75th Ave., Bayside, N.Y. 11364

[21] Appl. No.: 653,011

[22] Filed: Jan. 28, 1976

[51] Int. Cl.[2] ..... A63F 9/08

[52] U.S. Cl. ..... 273/153 S; 273/109

[58] Field of Search ..... 273/153 S, 109, 145 C, 273/145 CA

[56] References Cited

U.S. PATENT DOCUMENTS

| | | | |
|---|---|---|---|
| 1,251,400 | 12/1917 | Mees | 273/153 SU X |
| 1,381,164 | 6/1921 | Bradbury | 273/145 C |
| 2,262,886 | 11/1941 | Costantino | 273/109 |

*Primary Examiner*—Anton O. Oechsle

*Attorney, Agent, or Firm*—Kirschstein, Kirschstein, Ottinger & Frank

[57] ABSTRACT

A manipulative puzzle game consisting of a rectangular parallelepiped box having a transparent front wall. A plurality of identical cubes are disposed within the box. At least one plane face of each cube bears a visually distinguishing feature. The objective of the game is to arrange the cubes by manipulating the box, so that the visually distinguishing features of the cubes are in a selected order. The number of cubes is one less than the capacity of the box for such cubes. The width of the side walls of the box is slightly greater than the diagonal of a face of a cube, and less than twice the edge length of a cube, so that the stacks or layers of cubes are of a thickness of the edge dimension of a cube, i.e., one cube thick, and so that careful manipulation of the box by horizontal twisting or by tapping the box causes the rotation of at least one of the cubes about a central vertical axis. The height of the box is slightly greater then the total height of the highest stack of cubes in the box to permit at least one upper cube to roll over about a lower horizonal edge upon careful tilting of the box.

7 Claims, 9 Drawing Figures

PUZZLE GAME

BACKGROUND OF THE INVENTION

1. Field of the Invention

The invention relates to an amusement game of the type in which the object of the game is to arrange cubes in a desired orientation in a closed box by skillfully manipulating the box.

2. Description of the Prior Art

U.S. Pat. No. 2,296,001 discloses an amusement device consisting of a casing formed from a translucent or opaque material adapted to receive a plurality of dice. The casing has a window of a size to expose the faces of a lesser number of dice than are contained in the casing. The casing encloses five dice although it is big enough to contain many more. The height and depth (front-to-back) dimensions of the casing permits the cubes to be rolled but not to be spun about a horizontal space. Means is provided in the casing whereby only a lesser number of dice can be positioned before the window at the same time, while the extra dice are effectively hidden from view. To use the device, the casing is shaken to intermix the dice. When the casing is set down on a flat surface, three of the five dice will fall into view in the window.

Another reference of interest is the U.S. Pat. No. 2,526,123 which discloses a dice game having a hollow transparent body with eight compartments formed therein by transverse walls. A single different cube is positioned in each of the compartments which is considerably larger than the cube therein. Only four of the cubes are visible at any face of the body. To use the device, the hollow transparent body is tossed or rolled on a surface, causing the individual cubes to change positions in their respective compartments. When the hollow transparent body comes to rest, cubes adjacent to the upper face of the body will be visible through that face.

Other patents of interest include U.S. Pat. Nos. 2,225,519; 2,739,815; 2,985,453; 3,204,345 and 3,724,847.

SUMMARY OF THE INVENTION

PURPOSES OF THE INVENTION

It is an object of the present invention to provide an improved puzzle game.

Another object is to provide a puzzle game for the amusement of people of all ages.

A further object is to provide a puzzle game in which skillful manipulation as well as chance are used to attain a desired objective.

An additional object is to provide a puzzle game which is relatively simple to play and yet will provide a challenge and enjoyment to the player.

Still another object is to provide a puzzle game which may be played by one person or by a group of people.

Still a further object is to provide a puzzle game which is inexpensive and is readily fabricated and manufactured.

These and other objects and advantages of the present invention will become evident from the description which follows:

BRIEF DESCRIPTION OF THE INVENTION

In the present invention, a puzzle game is provided which consists essentially of a rectangular parallelepiped enclosure, such as a box, containing a plurality of cubes or other type of regular polyhedrons, all of which are identically shaped. At least the front wall of the box is transparent, and the number of cubes is no greater than one less than the capacity of the box for such cubes, to allow a free space in the box for movement of at least one upper cube. The dimensions of the enclosure relative to the cubes are such that the layers of cubes are each only one cube thick in a front-to-back direction, and such that the cubes may be manipulated, e.g., rotated, tumbled or twisted, by appropriate manipulation of the enclosure. It will be appreciated that a reasonable total number of cubes is contemplated since as will appear infra the game becomes more complex and difficult as the number of cubes is increased. A commercially practical maximum number of cubes is eleven and an optimum number of cubes in a preferred embodiment is five.

Each cube bears a distinguishing feature on at least one face, and the objective of the game is to so manipulate the enclosure, and thereby move the cubes, either by tumbling, turning or rotational movement of the enclosure, that ultimately all of the cubes are arranged with the distinguishing features facing through the transparent front wall and, optionally, with the cubes in a preselected arrangement. This result may be accomplished by tapping, tilting, twisiting or rotating the enclosure, or by analogous skillful manipulation. Since the element of chance is a factor, the game provides a great deal of amusement and challenges the skill of the players. Typical distinguishing features on at least one face of each cube include dice markings, numbers, letters, colors, symbols, or portions of a graphic arts illustration. In the latter instance the objective of the game would be to so arrange the cubes as to properly form an illustration, e.g., of a flower, a bird, an animal or a face.

To accomplish the proper fabrication of the game, the dimensions of the box or other rectangular parallelepiped enclosure are appropriately sized relative to the dimensions of the cube or other regular polyhedron. The width of the side walls of the box is slightly greater than and, no greater than two times, the greatest distance between the vertices of opposed angles of a perimeter of a plane face of one of the polyhedrons, e.g., the diagonal of a face of a cube, whereby the layers of cubes are on cube thick and careful manipulation of the box by horizontal twisting causes rotation of at least one of the polyhedrons about a central vertical axis. The height of the box is slightly greater than the total height of a vertical stack of cubes in the box, so as to permit at least one upper cube to roll over about the vertex of a lower horizontal dihedral angle upon careful tilting of the box.

Other alternatives and appurtenances may be provided in the puzzle game. The cubes may be beveled at their edges. One or a plurality of internal projections or tipping bumps may be provided on the inner surface of the enclosure, to facilitate the tipping of the cubes when the enclosure is moved or manipulated.

The puzzle game of the present invention provides several salient advantages. The game is simple yet challenging, since it combines an element of skill in manipulation with the element of chance. The game may be made with a greater or lesser degree of difficulty, depending on the number of cubes disposed in the enclosure. The game is readily and cheaply fabricated and may be carried about for amusement while traveling, etc. A sense of satisfaction is attained when the cubes are aligned in the proper order rather than in random fashion.

The invention accordingly consists in the features of construction, combination of elements, and arrangement of parts which will be exemplified in the device hereinafter described and of which the scope of application will be indicated in the appended claims.

BRIEF DESCRIPTION OF THE DRAWINGS

Referring now to the drawings.

DETAILED DESCRIPTION OF THE PREFERRED EMBODIMENTS

Figure 1:
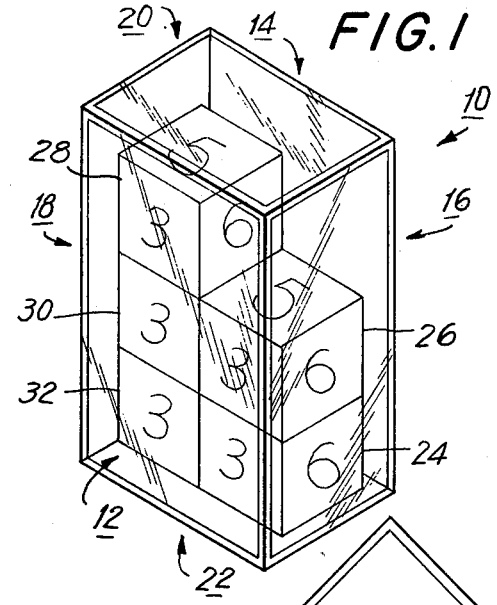
FIG. 1 is a perspective view of a typical puzzle game of the present invention.

Referring now to FIG. 1, a puzzle game 10 is shown consisting generally of a transparent rectangular parallelepiped box-like enclosure containing five identical cubes. The enclosure per se consists essentially of a front wall 12, a back or rear wall 14, side walls 16 and 18, a top wall 20 and a bottom wall 22. These walls of the enclosure are also shown to the extent possible in FIGS. 2, 4*a*, 4*b* and 5.

Internally disposed cubes 24, 26, 28, 30 and 32 are shown within the enclosure. All the cubes are of identical configuration (cubical) and size. The cubes bear different ones of numerals one through six on their six faces, and as shown in FIG. 1, the cubes are oriented in one typical desirable arrangement or puzzle solution, e.g., one in which all of the cube faces bearing the numeral three face in the same direction (forwardly), and the numeral three is upright on each cube face.

Figure 4A:
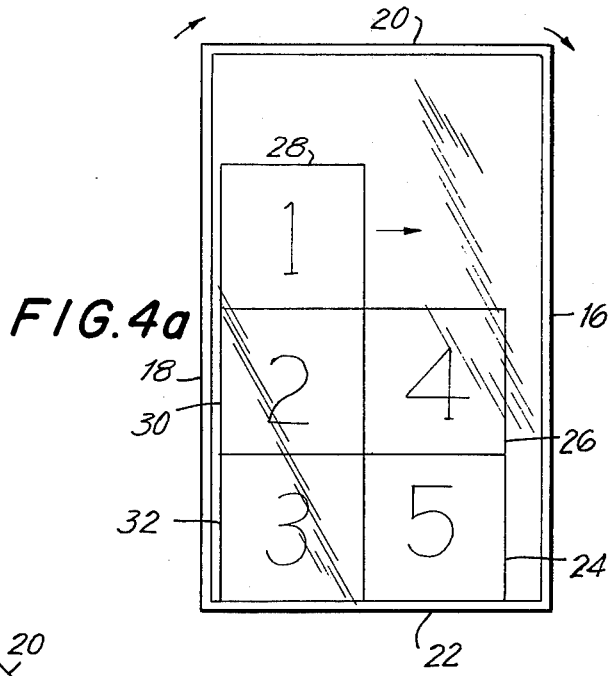
FIG. 4*a* shows an alternative motion of cubes by completely tipping the enclosure by more than 90° about a horizontal axis.

An alternative solution would be one in which all of the cube faces facing forwardly have the numbers in a sequence as shown in FIG. 4*a*.

The cubes might also have their different faces distinguished by different colors. For instance, the six different faces could be respectively colored white, black, yellow, red, blue and green and a desired arrangement could be to have all of the cube faces that face forwardly of the same color in a particular pattern of colors.

Still further the cubes could have their different faces carry fragmented portions of a single design, photograph, symbol, illustration or drawing and a desired arrangement could be one in which the forwardly facing faces combine to present the design etc. of the composite fragments.

The internal dimensions of the enclosure are slightly greater than the dimensions of the cubes viewed as a whole, as discussed supra, and in this specific embodiment the number of cubes is one less than the capacity of the enclosure.

Figure 2:
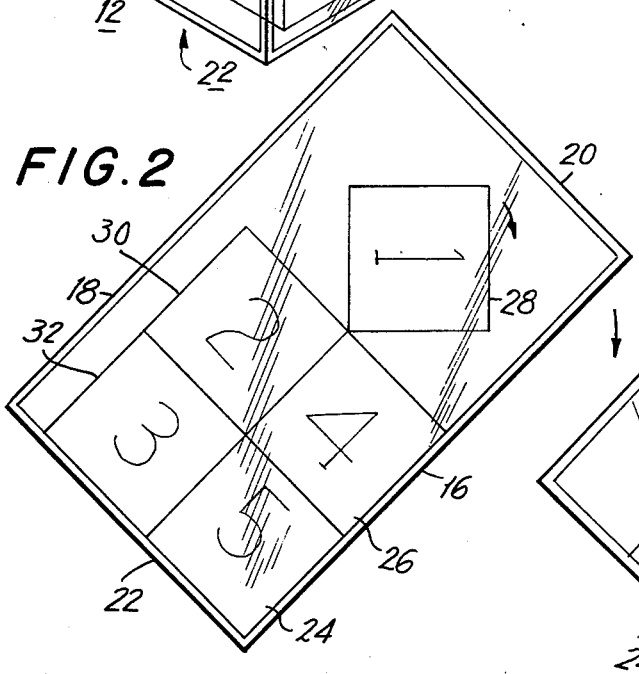
FIG. 2 shows the enclosure being slightly tipped to accomplish the tipping or rolling over of the single upper cube about the vertex of a lower dihedral angle.
Figure 3:
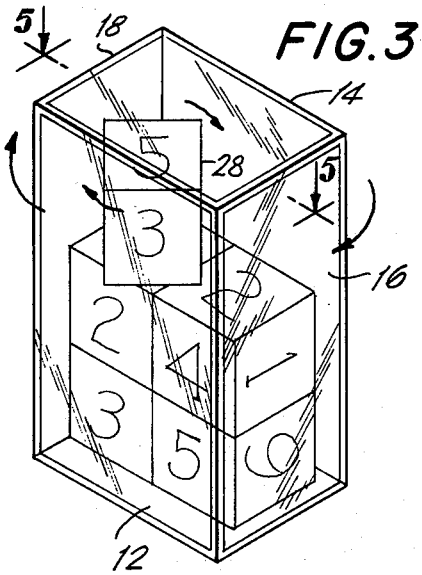
FIG. 3 shows the enclosure being twisted or rotated to cause rotation of the uppermost cube about a central vertical axis.
Figure 5:
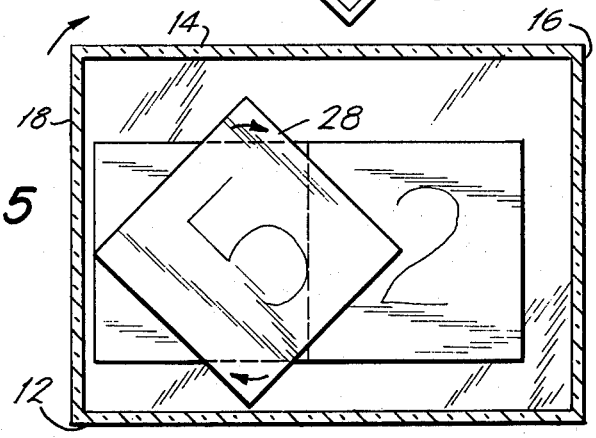
FIG. 5 taken substantially on section 5—5 of FIG. 3, shows the rotary motion of an uppermost cube about a central vertical axis.

With specific regard to exemplificative enclosure dimensions, the width (front-to-back) of a side wall 16 or 18 is greater than the diagonal of a face of a cube, so that manipulation of the enclosure by horizontal twisting readily causes the rotation of at least the uppermost cube 28 about a central vertical axis, as can be clearly seen in FIGS. 3 and 5. The height of the box is sufficiently greater than the total height of the highest vertical stack of cubes in the box, namely that of cubes 28, 30 and 32, so that careful tilting of the box as shown in FIG. 2 permits the upper cube 28 to roll over about the vertex of a lower horizontal dihedral angle.

Figure 4B:
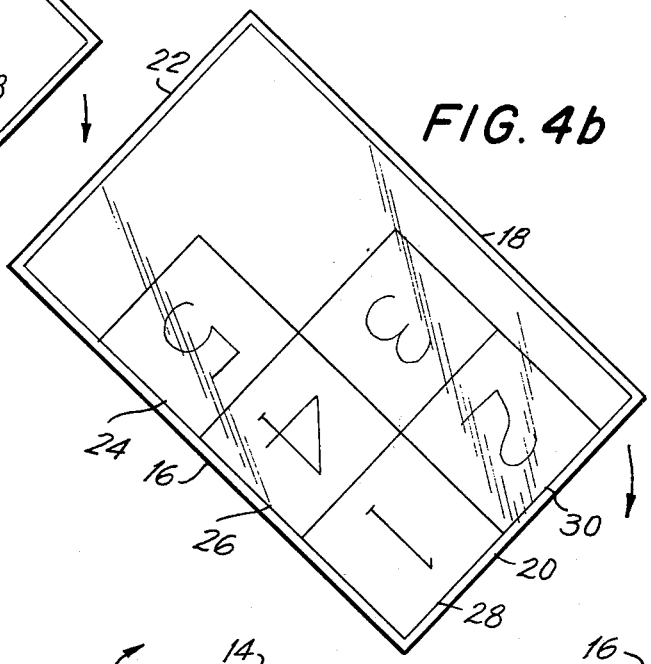
FIG. 4*b* shows the further tipped enclosure and the displacement of the interrelationship of the cubes.

FIGS. 4*a* and 4*b* illustrate an alternative mode of motion of the cubes by appropriate manipulation of the enclosure, namely a lateral shifting of the uppermost cube 28, rather than the tipping as shown in FIG. 2, followed by a complete displacement of cube 28 to a position adjacent to cube 26 as shown in FIG. 4*b*. The return of the enlcosure to an upright position from the orientation of FIG. 4*b*, not shown, would result in one stack of cubes 24, 26 and 28 and another stack consisting solely of cubes 30 and 32. Alternatively, since the enclosure is of regular dimension, the motion of FIGS. 4*a* and 4*b* taken in conjunction may be continued to attain a complete 180° displacement of the enclosure, i.e., the enclosure may be turned completely upside down in which case cube 24 could be subsequently tilted or rotated in accordance with FIGS. 2 or 3 respectively.

Figure 6:
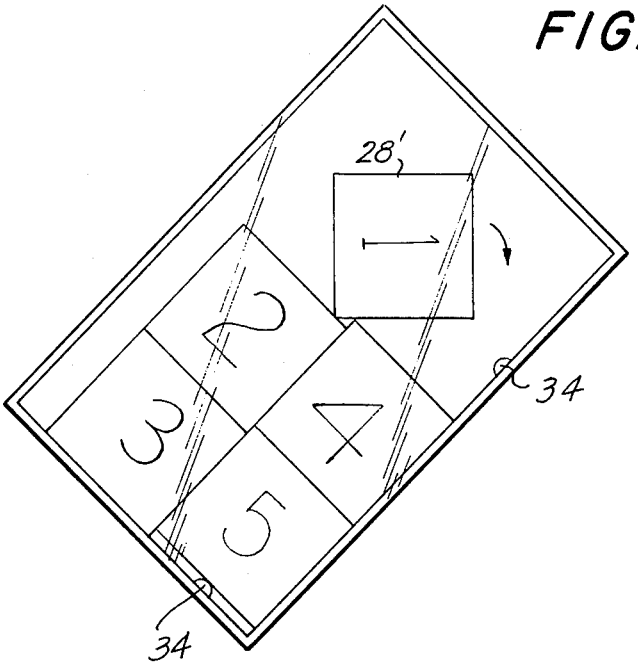
FIGS. 6, 7 and 8 show how the tipping motion of a cube is facilitated by a tipping bump.
Figure 7:
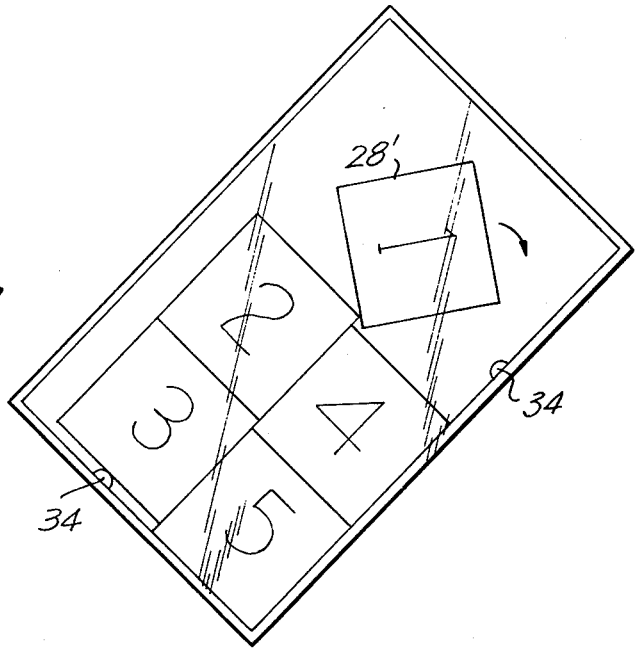
Figure 8:
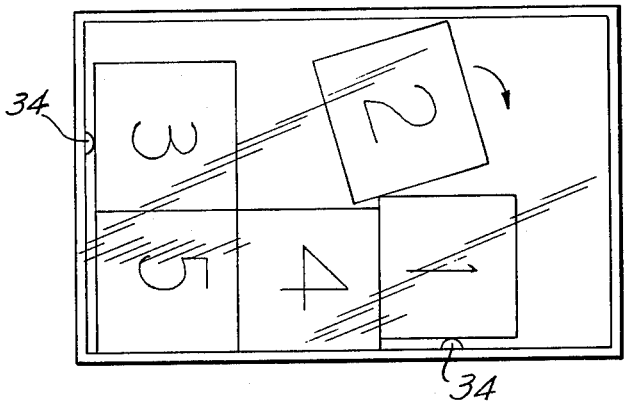

Referring now to FIGS. 6, 7 and 8, a plurality of appropriate internal tipping bumps in the form of projections 34 are provided in this preferred embodiment of the invention, to facilitate the tipping motion of the cubes when the enclosure is manipulated, by making one stack of cubes slightly higher or lower than the adjacent stack of cubes. Thus, FIG. 6 shows tipping of the cube 28' with an upwards displacement due to the lower tipping bump 34, FIG. 7 shows downwards displacement of the cube 28' due to the lower tipping bump 34, and FIG. 8 shows horizontal tipping of a cube facilitated by a tipping bump 34.

The FIGS. 2, 3, 4*a*, 4*b* and 5 illustrate various ways of attaining the objectives of the game, which basically entail getting the cubes into desired individual and mutual positions by turning and/or twisting of the box, or by other appropriate manipulation of the box. After some time with the puzzle game, one will gain the skill of manipulating the cubes as he wants, but no matter how skillful, chance is also a major factor.

Numerous alternatives within the scope of the present invention, besides those alternatives mentioned supra, will occur to those skilled in the art. Thus, other forms of regular polyhedrons may be provided in practice. At least the front wall of the box or other enclosure is transparent, however as shown in the FIGURES, all of the walls may be transparent. In instances where a greater plurality of cubes is provided, the total number of cubes may be two or even three less than the capcity of the box, e.g., a box with a total capacity for nine cubes could contain seven or eight.

In a typical construction, the enclosure is a clear plastic box measuring $2\frac{1}{2} \times 1\frac{1}{2} \times 1$ inch, containing five cubes $\frac{5}{8}$ of an inch to an edge.

To summrize, various types of motions of the cubes may be achieved. Thus, an individual cube, particularly if it is a cube on the top horizontal row, can be rolled as shown in FIG. 2; an individual cube, particularly if it is a cube in the top horizontal row, can be spun about a vertical axis as shown in FIG. 5. The two motions aforesaid enable different faces of the cubes to be faced forwardly. Also by simple translation of the cubes, horizontally or vertically as indicated by the arrows in FIG. 4*a*, the cubes can be shifted from one vertical stack to another or from one horizontal row to another.

In the preferred embodiments of the invention, as noted previously, there is one cube less than the capcity of the box whereby all but one vertical stacks are of the maximum height that will fit within the enclosure and all horizontal rows have the maximum number of cubes therein except the top row.

It thus will be seen that there is provided a puzzle game which acheives the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense.

Having thus described the invention, there is claimed as new and desired to be secured by Letters Patent:

1. A manipulative puzzle game comprising a substantially rectangular parallelepiped box having a bottom, a top, opposed side walls, a front wall and a back wall, the side walls of said box being narrower than said front wall and said back wall, said front wall being transparent, and a plurality of identically shaped regular polyhedrons, said polyhedrons being disposed within said box in a plurality of juxtaposed stacks, the number of said polyhedrons being one less than the capcity of said box for such polyhedrons, whereby one of the stacks of polyhderons contains one less polyhedron than the balance of stacks or layers of polyhedrons, the width of the side walls of said box being slightly greater than the greatest distance between the vertices of opposed angles of a perimeter of a plane face of one of said polyhedrons, whereby careful manipulation of said box by horizontal twisting causes rotation of at least one of said polyhedrons about a central vertical axis, and the height of said box being slightly greater than the total height of one of the stacks of polyhedrons in said box to permit the upper polyhedron in said one stack to roll over about the vertex of a lower horizontal dihedral angle upon careful tilting of said box, at least one plane face of each of said polyhedrons bearing a visually distinguishing feature.

2. The manipulative puzzle game of claim 1, in which each polyhedron is a cube.

3. The manipultive puzzle game of claim 2, in which the number of stacks is two, the number of cubes is five, and the capacity of the box is six cubes.

4. The manipulative puzzle game of claim 1, in which the visually distinguishing feature is a number.

5. The manipulative puzzle game of claim 1, further including at least one internal projection on an inner surface of the box, to aid in the tipping movement of at least one of the polyhedrons when the box is manipulated.

6. The manipulative puzzle game of claim 1, in which the bottom of the box is a flat planar member, whereby the polyhedrons are positioned on a flat uniformly planar surface.

7. A manipulative puzzle game comprisng a substantially rectangular parallelepiped box having a bottom, a top, opposed side walls, a front wall and a back wall, the side walls of said box being narrower than said front wall and said back wall, said front wall being transparent, and five identically shaped cubes, said cubes being disposed within said box in a plurality of juxtaposed stacks, the capacity of said box for such cubes being six, whereby one of the stacks of cubes contains one less cube than the balance of stacks or layers of cubes, the width of the side walls of said box being slightly greater than the diagonal of a face of a cube, whereby careful manipulation of said box by horizontal twisting causes rotation of at least one of said cubes about a central vertical axis, and the height of said box being slightly greater than the total height of one of the stacks of cubes in said box to permit the upper cube in said one stack to roll over about the vertex of a lower horizontal dihedral angle upon careful tilting of said box, at least one plane face of each of said cubes bearing a visually distinguishing feature.

* * * * *